United States Patent [19]

Ito et.al.

[11] Patent Number: 4,788,575

[45] Date of Patent: Nov. 29, 1988

[54] COPYING MACHINE FOR DETECTING A WORKABLE DOCUMENT TURNOVER UNIT

[75] Inventors: Masazumi Ito, Toyohashi; Syuji Maruta; Tadashi Ohira, both of Toyokawa, all of Japan

[73] Assignee: Minolta Camera Kabushiki Kaisha, Osaka, Japan

[21] Appl. No.: 7,753

[22] Filed: Jan. 28, 1987

[30] Foreign Application Priority Data

Jan. 29, 1986 [JP] Japan ..... 61-17403

[51] Int. Cl.[4] ..... G03G 15/00; B65H 29/00

[52] U.S. Cl. ..... 355/14 SH; 355/3 SH; 355/24; 355/26; 271/186

[58] Field of Search ..... 355/14 SH, 3 SH, 23, 355/24, 26; 271/291, 186, 902, 265, 111

[56] References Cited

U.S. PATENT DOCUMENTS

| | | | |
|---|---|---|---|
| 4,231,561 | 11/1980 | Kaneko et al. | 271/186 X |
| 4,234,180 | 11/1980 | Looney | 271/902 |
| 4,238,126 | 12/1980 | Langdon | 271/902 |
| 4,264,067 | 4/1981 | Adams et al. | 271/902 |
| 4,385,756 | 5/1983 | Beery | 271/186 |
| 4,419,007 | 12/1983 | Kingsley | 271/186 |
| 4,456,236 | 6/1984 | Buddendeck | 271/186 X |
| 4,487,506 | 12/1984 | Repp et al. | 271/902 |
| 4,493,483 | 1/1985 | Teumer et al. | 271/186 |
| 4,553,828 | 11/1985 | Burger et al. | 355/14 SH |
| 4,576,472 | 3/1986 | Ito et al. | 355/14 SH |
| 4,579,326 | 4/1986 | Pickney | 271/186 X |
| 4,579,446 | 4/1986 | Fujino et al. | 271/186 |
| 4,610,446 | 9/1986 | Ide | 271/186 X |
| 4,629,173 | 12/1986 | Hashimoto et al. | 355/14 SH |
| 4,657,238 | 4/1987 | Nishikawa | 271/186 |
| 4,669,717 | 6/1987 | Yamashita et al. | 271/186 |
| 4,673,176 | 6/1987 | Schenk | 271/186 |

*Primary Examiner*—R. L. Moses

*Attorney, Agent, or Firm*—Burns, Doane, Swecker & Mathis

[57] ABSTRACT

A copying machine having a function of prohibiting the operation of an automatic document take-up unit. This copying machine includes an automatic document take-up unit and a document feeder for feeding a document, a document turnover unit for turning over the document for copying of both sides of the document, a designating unit for designating a copy side, a detecting unit for detecting whether the document turnover unit is attached or not, and a prohibiting unit for prohibiting the automatic document take-up unit from operation in case the document turnover unit is not attached.

6 Claims, 7 Drawing Sheets

COPYING MACHINE FOR DETECTING A WORKABLE DOCUMENT TURNOVER UNIT

BACKGROUND OF THE INVENTION

1. Field of the Invention

The present invention relates to a copying machine and more specifically to a copying machine having a prohibiting unit which prohibits the operation of an automatic document take-up unit in case a document turnover unit is not attached. 2. DISCUSSION OF THE BACKGROUND The conventional copying machine is composed of a copying machine body 30 as shown in FIG. 1 and a control unit (not shown.)

The copying machine body 30 has a glass plate 315 on which a document 90 to be copied is placed and scanned optically, and a copy image forming unit 33 which scans optically the document 90 placed on the glass plate 315, forms an electrostatic latent image on a photosensitive medium, further, transfers the electrostatic latent image on a sheet of copy paper 95 after development and then, letters, figures and etc., appear on the copy paper 95.

The following units can be attached to the copying machine body 30;

an automatic document take-up unit 35 which holds and feeds documents 90, a document feeder 31 which feeds said documents 90 to a fixed place on the glass plate 315, and a document turnover unit 41 which turns over both sides of the document 90 and carries it to the glass plate 315, so that the opposite side 92 of the document 90 can contact the glass plate 315. This document turnover unit 41 can be attached to a turnover unit holder 37. The automatic document take-up unit 35, combining with the document feeder 31, is called an automatic document feeder (hereinafter referred to as A.D.F.) generically.

Also, this copying machine with an A.D.F. has a function to copy both sides of the document 90 on both sides of a sheet of copy paper 95 and to copy both sides of the document 90 on one side of two sheets of copy paper 95.

It is necessary to attach the document turnover unit 41 to the turnover unit holder 37 in order to copy the opposite side 92 of the document 90 on a sheet of copy paper automatically. Normally, the document turnover unit 41, the document feeder 31 and the automatic document take-up unit 35 will be sold on the market separately from the copying machine body 30. Some copy machine users do not have the document turnover unit 41. Further, there may be some users who do not know that the opposite side 92 of the document 90 can not be copied even if the document was set on the automatic document take-up unit 35 and the prescribed operation was carried out according to an instruction from an operation panel when the document turnover unit 41 was not attached to the copying machine body 30.

Therefore, an object of the present invention is to provide the copying machine with a function to prohibit the automatic document take-up unit 35 from working even if a prescribed operation is carried out according to an instruction from the operation panel when the document turnover unit 41 is not attached to the copying machine body 30.

SUMMARY OF THE INVENTION

The A.D.F. and the document turnover unit 41 can be attached to the copying machine of the present invention. The document turnover unit 41 turns over both sides of the document 90 discharged from the A.D.F. and feeds the document 90 back to the A.D.F. Also, the copying machine of the present invention feeds the document to the document turnover unit 41 and designates selectively the two-sided copy mode which enables copying both sides of the document 90 automatically.

Accordingly, the feature of this copying machine of the present invention is that it is provided with an attachment detecting unit 73 to detect if said document turnover unit 41 is attached to the copying machine in a workable state. A control unit is provided to prohibit at least the operation of said A.D.F. in a case where the two-sided copy mode of a document 90 is designated and said attachment detecting unit 73 detects that the document turnover unit 41 is not attached.

That is, the copying machine of the present invention comprises a copying machine body to the A.D.F. and the document turnover unit 41 are attachable, and a control unit having an attachment detecting unit 73 which detects if the document turnover unit 41 is attached, a designating unit which designates the operation mode including the designation of a copy side, and a prohibiting unit which prohibits the two-sided copy mode.

A copying machine body in the present invention, for example, the conventional copying machine body can be used with or without partial improvement.

The attachment detecting unit 73 detects if the document turnover unit 41 is attached to the copying machine body 30 in a workable state. That is, this attachment detecting unit 73 has a detector (it is not necessary to be active and no problem to use passive elements such as switches, etc.) which outputs a signal, which indicates to the control unit if the document turnover unit 41 is workable, and the control unit can prohibit the operation of the two-sided copy mode described later.

The copy side designating unit is the unit which designates a copy side of the document. That is, the designation of a copy side is to designate whether only one side of the document is copied or both sides of the document is copied successively. In this copy side designating unit, mechanical switches such as select switches, push-button switches etc., are used. Also, voice switches which designate a copy side by voicing as <side A copy, side B copy> may be used, and further, an automatic reading device may also be used and it designates a one-sided copy or two-sided copy according to the automatic determination by reading the copy side designating mark set on the corner of one side of each copy paper. As switches and sensors are used for said unit, well-known piezoelectoric elements, magnetic leaders and approach switches etc., are usable.

The prohibition of the two-sided copy mode is done by means to prohibit the operation of the automatic document take-up unit 35 despite of the automatic copy instruction from an automatic copy instructing unit. The prohibiting is done when the signal from the copy side designating unit is the two-sided copy signal and the signal from the attachment detector 73 is the signal of non attachment which indicates the document turnover unit 41 is not attached.

The two-sided copy prohibiting unit, for example, may be a locking device which prohibits the operation of the automatic copy instructing unit mechanically or an electrical circuit which controls the automatic take-up unit according to the result of both signals from the copy side designating unit and from the attachment detector 73. The circuit can be constituted by either hardware or software.

According to the present invention it is described hereinbelow when a user intends to copy both sides of a document on both sides of a sheet of copy paper without knowing that the document turnover unit 41 is not attached to the copy machine body 30 or not in a workable state due to disconnection, etc.

The user operates the automatic copy instructing unit after setting the document 90 on the automatic document take-up unit 35 and carrying out the fixed instruction operation by the operation panel. The attachment detector 73 outputs the signal, which indicates the document turnover unit 41 is not workable to the two-sided copy prohibiting unit. Accordingly, the two-sided copy prohibiting unit does not allow the automatic document take-up unit 35 to work according to the two-sided copy signal designated by the user and the signal from the attachment detector 73, even if the user operates the automatic copy instructing unit. This process is carried out directly or through a control part. In this manner, the automatic document take-up unit 35 is prohibited from working by the impracticable operation mode.

In this case, the user can set the copy side designating unit 75 to the one-sided copy mode, so that it becomes possible to copy one side of the document or to copy both sides of the document by manual operation.

BRIEF DESCRIPTION OF THE DRAWINGS

FIGS. 6 to 9 are flow charts showing the programs respectively carried out by a computer used in the embodiment, in which FIG. 6 shows a main copying program processed by the computer; FIG. 7 shows a confirmation of a copying preparation processed by the computer; FIG. 8 shows a processing of the copying preparation by the computer; and FIG. 9 also shows a processing of the copying preparation by the computer.

DESCRIPTION OF THE PREFERRED EMBODIMENT

Figure 1:
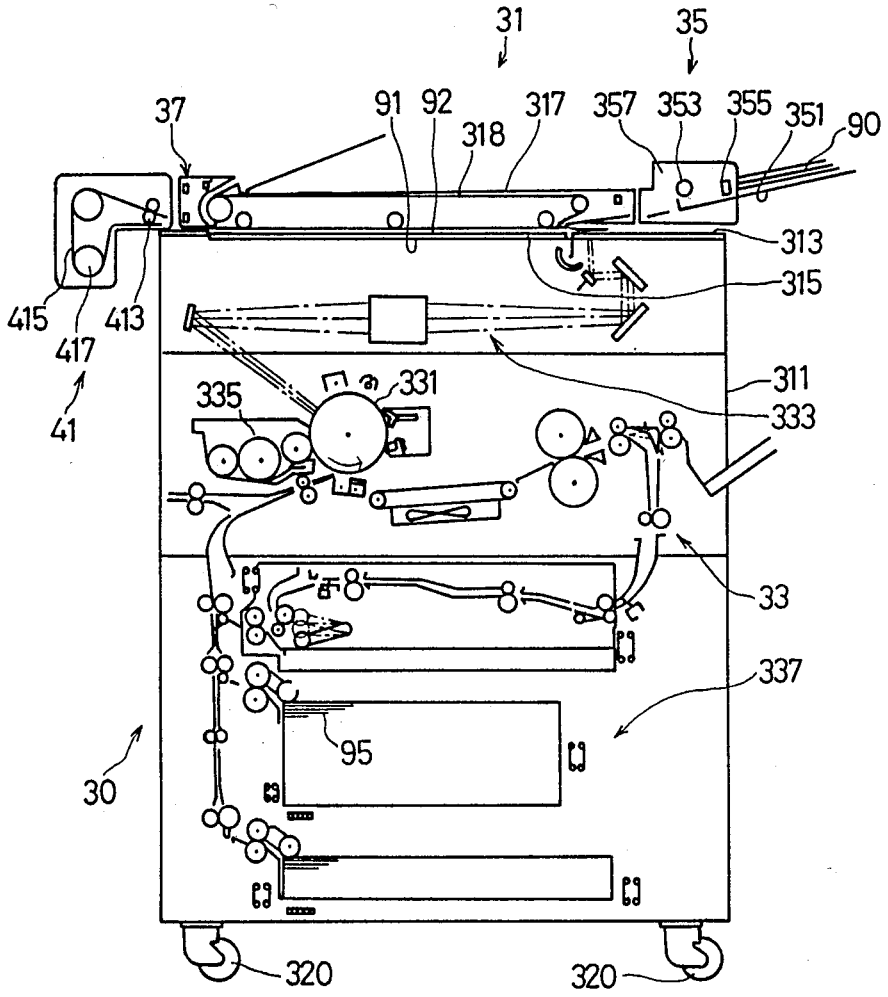
FIG. 1 is an inner structural view which shows uncovered inner structure of a copying machine body relating to an embodiment of the present invention.
Figure 2:
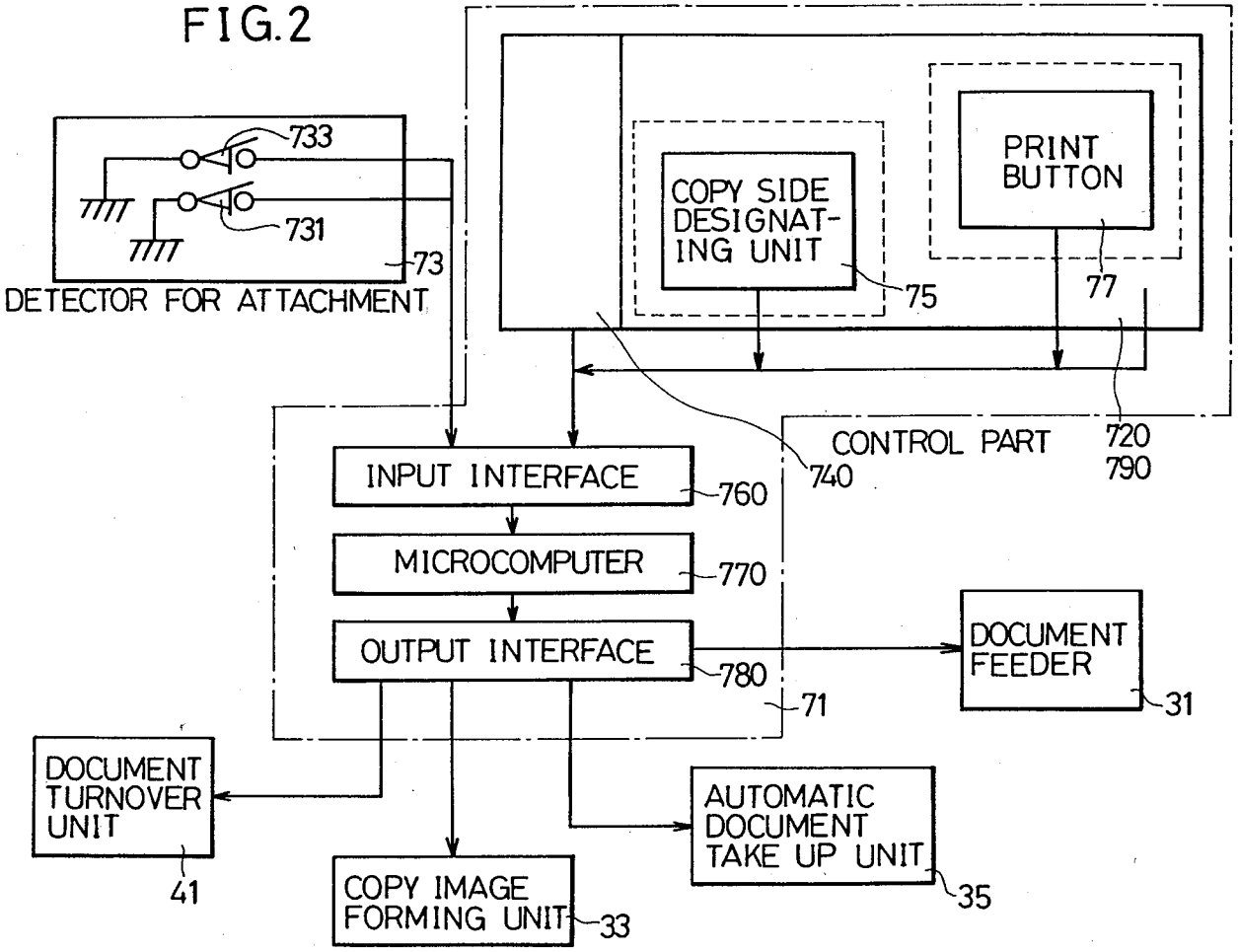
FIG. 2 is a block diagram of the control unit used in the embodiment.

The copying machine of the present invention is described in detail with reference to the illustrated embodiment. For the embodiment, the conventional copying machine except the two-sided copy prohibiting unit of the control unit, is used without requiring any other improvement on it. Accordingly, except for the component of the two-sided copy prohibiting unit, only a brief description is made on each component as follows. The copying machine in this embodiment is composed of a copying machine body 30 of which the uncovered inner structure is shown in FIG. 1 and a control unit 70 of which the block diagram is shown in FIG. 2. The copying machine body 30 is composed of a glass plate 315, a copy image forming unit 33, a document feeder 31, an automatic document take-up unit 35 and a turnover unit holder 37.

The copying machine body 30 is mainly composed of a box type container 311, a frame work 313 shaped like a picture frame, a glass 315 and a document feeder 31. The container 311 is movable with four wheels and contains the copy image forming unit 33, etc. The frame work 313 is set on the container 311 horizontally. The glass plate 315 is set within the frame work 313 and the other side 91 of the document 90 (up to the format size of A3) is placed thereon in contact with the glass plate 315. Accordingly the letters, figures, and etc., on the other side 91 are scanned optically from the opposite side of the contact surface. The document feeder 31 comprises a cover 317. The cover 313 is held on the frame work 313 in such a manner that pivoting of the open and closed part is along longitudinal direction of the frame work and the cover 313 presses down on the opposite side 92 of the document 90 on the glass plate 315. Cover 317 has a feed belt 318 which contacts with the opposite side 92 of the document 90 and feeds said document 90 forward.

The copy image forming unit 33 (controlled by a control part 71 of a control unit 70 described later) is mainly composed of an optical system 333 which scans letters and figures from the other side 91 of the document 90 placed on the glass plate 315 and forms the electrostatic latent image of those letters and figures on the surface of a photosensitive medium 331, a developing unit 335 which transfers the electrostatic latent image on a sheet of copy paper 95 and reproduces the letters and figures on the copy paper 95 by using toner, and a copy paper feeder 337 which feeds or discharges the copy paper 95 to or from the developing unit 335 in accordance with the copy side designating mode such as two-sided copying, one-sided copying or.

The automatic document take-up unit 35, which holds the document 90 and feeds said document 90 to the document feeder 31, is fixed on the right hand side of the upper part of the copying machine body 30. This document take-up unit 35 is mainly composed of a table 351 which places the documents 90 thereon in a pile, a cylindrical paper feed roller 353 which separates the pile of the document 90 on the glass plate 351 one by one and feeds them in the direction of the feed belt 318 (that is, in the direction of the glass plate 315), a driving motor (not shown) which drives said paper feed roller 353, a document detector 355 which detects if there is a document 90 on the table 351, and the document feeder body 357 which contains the table 351, the driving motor, the paper feed roller 353 and the document detector 355.

The turnover unit holder 37 is the part which detachably holds the document turnover unit 41 which is set on additionally to the copying machine of the present invention and said turnover unit holder 37 is set on the left side of the upper part of the glass plate 315.

The document turnover unit 41, which is attached to the copying machine of the present invention, is mainly composed of a connecting part connected with the turnover unit holder 37, and a dog, placed in the connecting part, which actuates the attachment detector 73 described later, and a roller 413 to receive the document 90 fed from the glass plate 315, a belt 415 to turn over both sides of the document 90 fed from the roller 413 and feed the document forward, and a roller 417 to drive said belt 415.

Meanwhile, the control unit 70, as seen in FIG. 2, is composed of a control part 71, an attachment detector 73, and an operation panel 710.

The control part 71 of the control unit 70 controls the copy image forming unit 33, the document feeder 31, the automatic document take-up unit 35 and the document turnover unit 41. This control part 71 is mainly composed of a microcomputer 770, an input interface 760 and an output interface 780. The micro computer 770 controls the copy image forming unit 33, the document feeder 31, the automatic document take-up unit 35 and the document turnover unit 41 through receiving various kinds of instructive signals from the operation panel 710 and the signal from the attachment detector 73.

Figure 3:
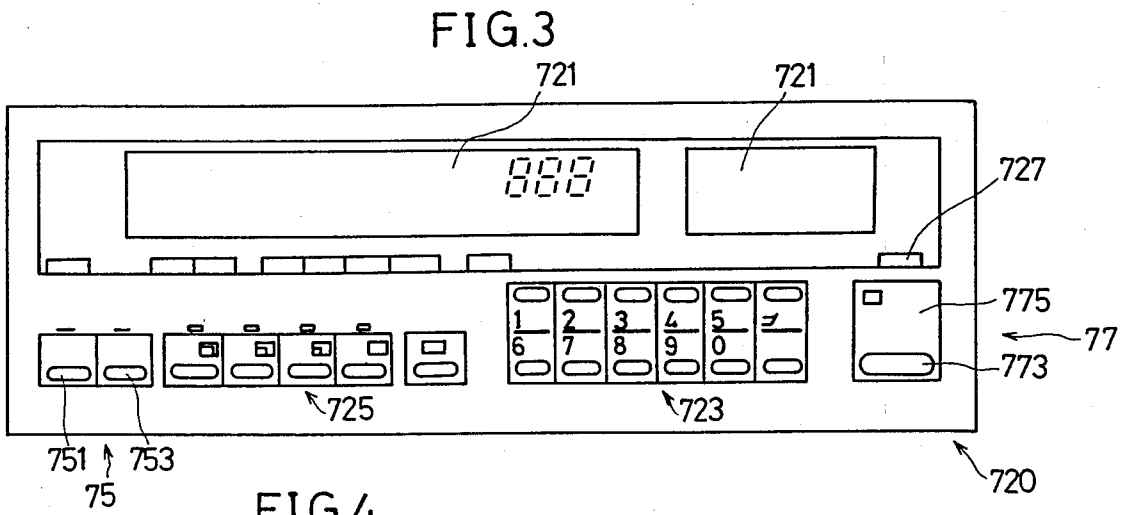
FIG. 3 is a front view of the first operation panel according to the embodiment of the present invention.
Figure 4:
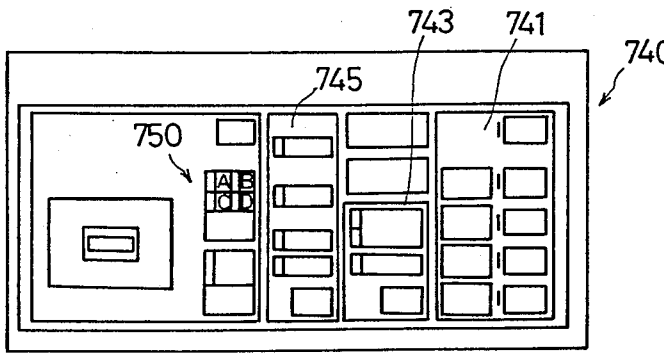
FIG. 4 is a front view of the second operation panel according to the embodiment of the present invention.

This operation panel 710 is composed of a first panel 720 which is set in front of the copying machine body 30 and used frequently, a second panel 740 which is set in left side of the first panel 720 and not used as frequently in comparison with first panel 720, and a panel 790 for the automatic document take-up unit which is set on the automatic document take-up unit 35. The first panel 720, shown in FIG. 3, comprises a liquid crystal indicator 721 which indicates the number of copying sheets, the various kind of fixed mode etc., a copy side designating unit 75 described later, a print button 77, ten keys which fix the numerical data, a magnification setting unit 725 which sets up the fixed copy magnification ratio such as reduction or enlargement etc., and a reset button 727, and so on. On the other hand, the second panel 740, shown in FIG. 4, comprises a zoom magnification ratio unit 741 which fixes the copy magnification ratio consecutively and memorizes them, a binding margin setting unit 743 which determines if a binding margin is set on the copy paper 95, a copying mode setting unit 745 which determines how to copy one side or both sides of the document 90 on the copy paper 90, and a editing unit 750 related to the editing of the copied paper.

Figure 5:
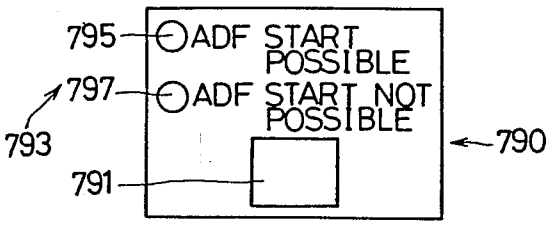
FIG. 5 is an explanatory drawing of an indicator of an automatic copy instructing unit and an automatic copy impossible indicating unit used in the embodiment.

The panel 790 for the automatic document take-up unit feeder as shown in FIG. 5 comprises an A.D.F. start button 791 and an automatic copy impossible indicator 793.

The attachment detector 73 in the control unit 70, which detects if the document turnover unit 41 is attached to the copying machine body 30 of the present invention, is set in the corner hole of the turnover unit holder 37 and comprises two limit switches 731 and 733 having the roller on the top of each actuater (not shown).

The copy side designating unit 75 is the unit to designate a copy side of the document 90 and is set on the left side of the first panel 720. This copy side designating unit 75 is composed of a one-sided copy setting button 751 actuated to copy both sides of the document 90 on one side of two sheets of copy paper 95, and a two-sided copy setting button 753 actuated to copy both sides of the document 90 on both sides of a sheet of copy paper 95.

The print button 77, which is set on the right side of the first panel 720 is the button to initiate a copy cycle when a document is placed on the glass plate 315 by hand after the document feeder 31 is raised. This print button 77 has a lighted press switch. The lighted press switch comprises a switch part 773 to start copying and a indicator part 775 to indicate the operation of the switch part 77.

The two-sided copy prohibiting unit is composed of the determination means and automatic copy impossible indicator 793. The determination means outputs the control signal to prohibit the operation of the automatic document take-up unit 35 despite the automatic copy instruction signal from the A.D.F. start button 791 in case that the signal from the copy side designating unit 75 is the two-sided copy signal and the signal from the attachment detector 73 is the non-attachment signal. The automatic copy impossible indicator 793 indicates that the automatic document take-up unit 35 is prohibited from operating according to the control signal from the above determination means.

Figure 7:
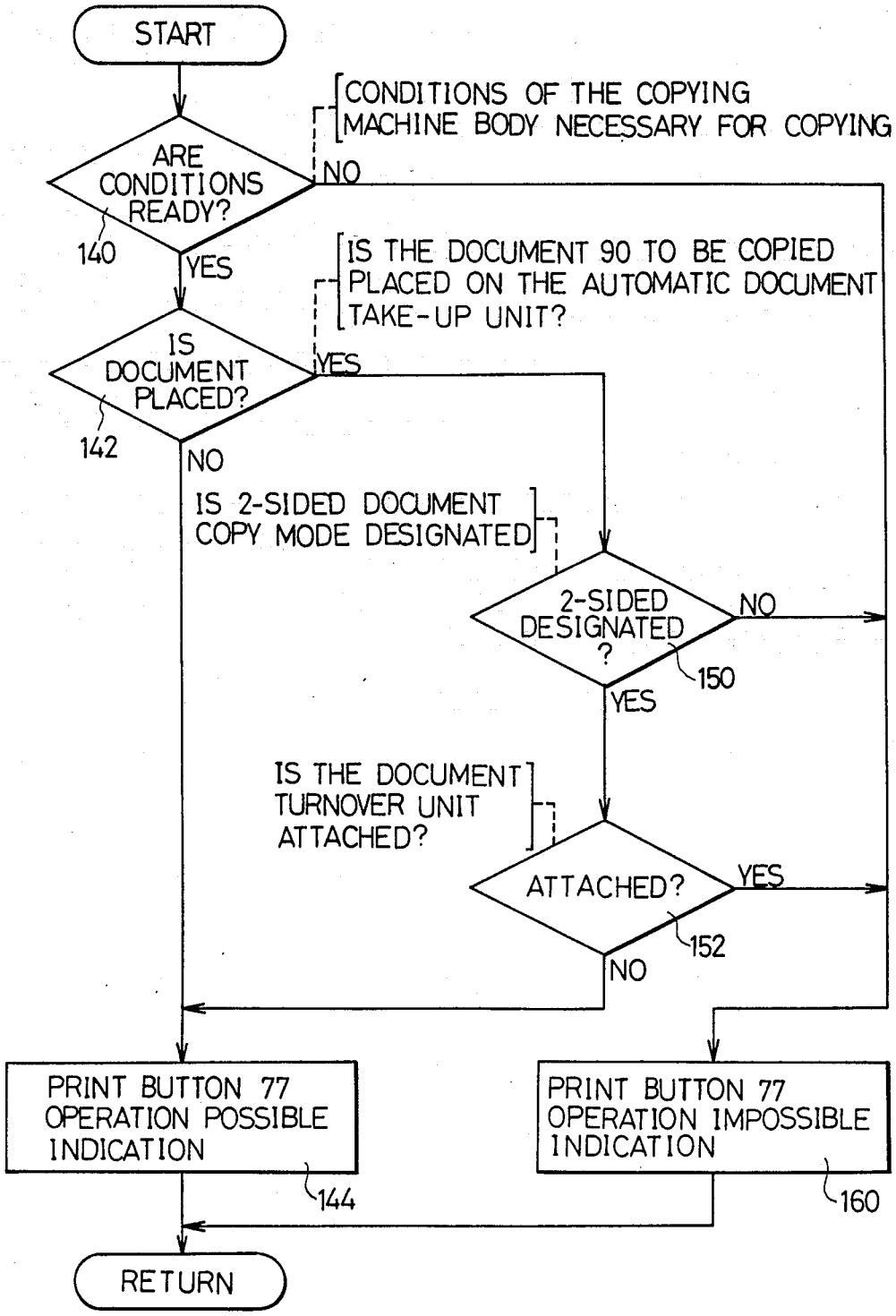
Figure 8:
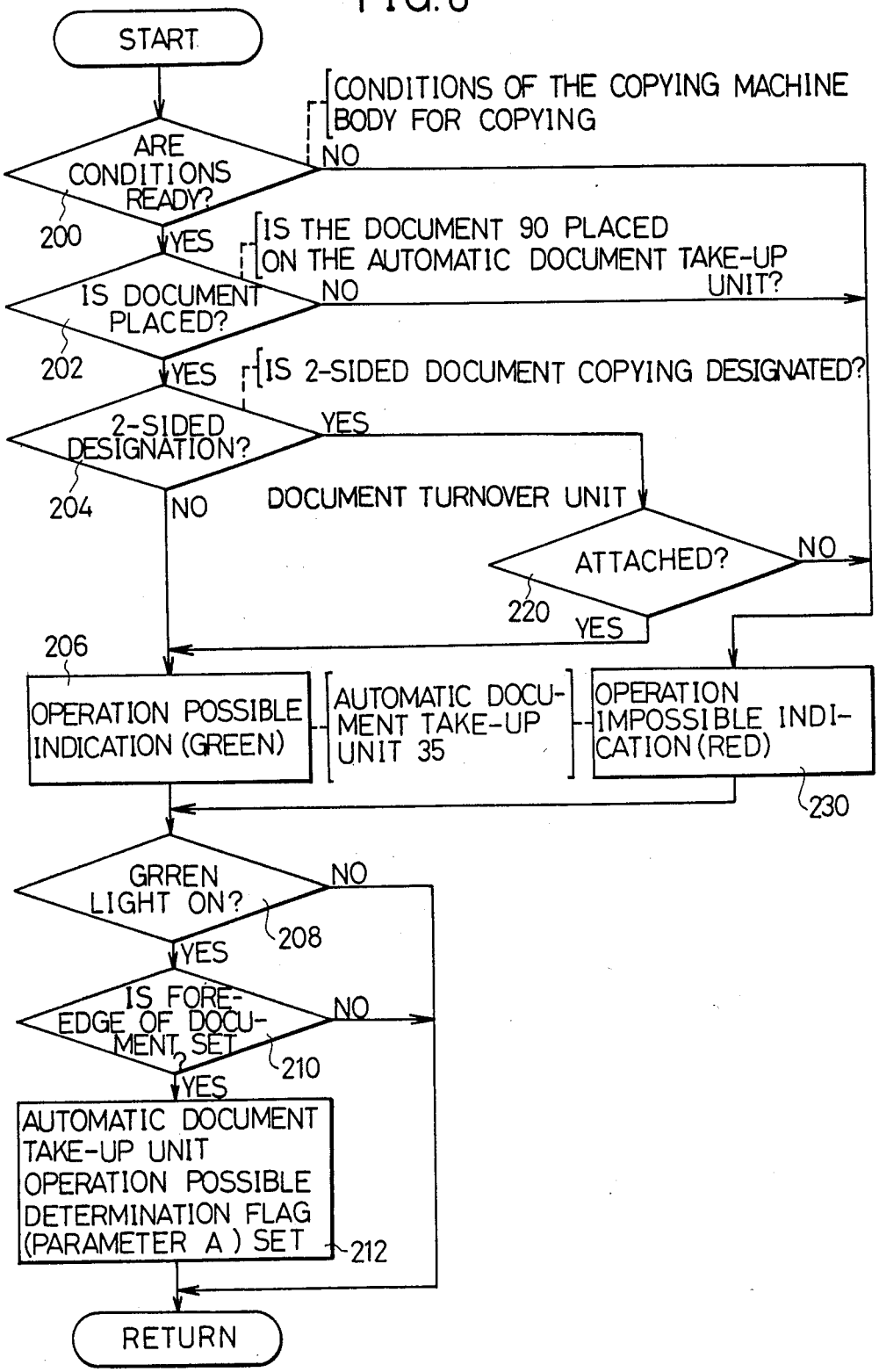

This determination means is composed of the microcomputer 770 (hereinafter referred to as computer 770) and two sub programs (hereinafter referred to as subroutines which are written in said computer 770 and called out from the main program of the copying work. One of these subroutines as shown in FIG. 7 is the first subroutine for the processing to confirm preparation of copying and the other one is the second subroutine, as shown in FIG. 8, for the processing to prepare for the operation of the automatic document take-up unit 35. The automatic copy impossible indicator 793 as shown in FIG. 5 is placed in the panel 790 for the automatic document take-up unit 35. This automatic copy impossible indicator 793 is composed of a green colored luminous diode 795 indicating the approval of automatic copying and a red colored luminous diode 797 indicating the disapproval of automatic copying.

Figure 6:
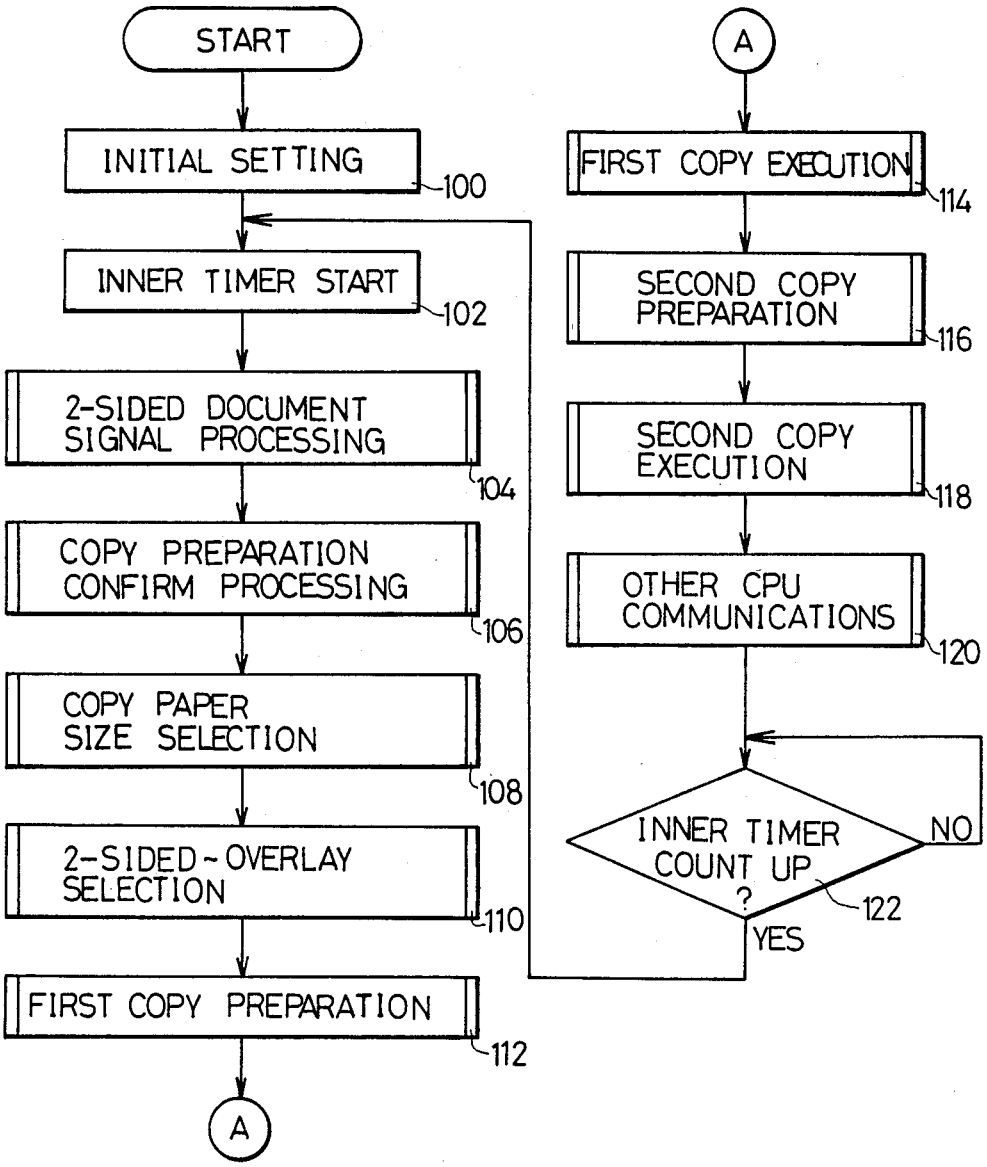

The function of the units in this embodiment is described according to the flow chart in FIG. 6 which shows the main program of the copying work carried out by the computer 770.

The computer 770 carries out the program from Step 100 after the start switch of the control unit 70 in the copying machine is turned on. Step 100 is the step to set various kinds of parameters initially, that is, the computer 770 clears the fixed address region of the RAM and each of the registers and initializes the unnecessary mode set by the user before using the copying machine.

After finishing the operation of Step 100, the computer 770 proceeds to Step 102 and starts to count by actuating the inner timer built therein. This counting means counts the time needed for one subroutine.

After carrying out each subroutine of Step 102 or 120 one by one, the computer 770 jumps to Step 102 if it was determined at Step 122 that the counted value of the timer in Step 102 was higher than the fixed value. Then, the computer 770 carries out Step 102 or 122 repeatedly.

The subroutines carried out by the computer 770 after Step 102 are the programs to carry out the processing described below;

A two-sided document signal processing which receives the signal from the copy side designating unit, a processing to confirm preparation of copying which confirms if copying work is possible, a processing to determine the size of the copy paper to be fed according to the signal from the panel 710, etc., a processing to determine if it forms copy image on one side or both sides of a sheet of copy paper 90, a first copy preparation processing which is carried out in case of one-sided document copying, a first copy execution processing for execution of the one-sided document copying, a second copy preparation processing which is carried out in case of the other one-sided document copying, a second copy execution processing for execution of the other one-sided document copying, and a communication processing to communicate with other micro computers.

These subroutines except the processing to confirm preparation of copying and the first and second copy preparation processing, are the same as the programs carried out by the conventional control unit. Therefore, as to the conventional subroutines flow charts and descriptions for them are omitted.

Now, the processing to confirm preparation of copying characterizing the present invention is described according to the flow chart in FIG. 7 which shows the program carried out by the computer 770.

The computer 770 starts to carry out Step 140 when the processing to confirm preparation of copying is called out from the main program.

At Step 140, the computer 770 determines various kinds of conditions necessary for copying. What will be determined at this step are, for example, the determination whether there is copy paper or not, the determination whether there is enough quantity or not to develop and so on. In Step 140, if it is determined that copying is not possible according to above determinations, the computer 770 jumps to Step 160 and indicates that the print button 77 is not workable (it means the light of the indicator 775 is out), and then, returns to the main program.

Meanwhile, if the determination at Step 140 shows copying is possible, the computer 770 determines at Step 142 if the document 90 is placed on the automatic document take-up unit 35. If it is determined according to the signal from the document detector 355 that the document 90 is not in place, the computer 770 proceeds to Step 144 and indicates the print button 77 is workable (it means the light of the indicator 775 is on), and then, returns to the main program.

If it is determined at Step 142 that the document 90 is placed on the automatic document take-up unit 35, the computer 770 determines the signal from the copy side designating unit 75 at Step 150. If it is determined that said signal is a two-sided copy signal, the computer 770 proceeds to Step 152, and then, determines the signal from the attachment detector 73. Then, the computer 770 jumps to Step 144 and returns to the main program after the fixed processing described previously in case it is determined that the document turnover unit 41 is not attached. That is, even if two-sided document copying is designated, the normal copying initiated by the print button 77 is allowed in case the document turnover unit 41 is not attached. Also, if it is determined at Step 150 that the signal is not for two-sided document copying or determined at Step 152 that the document turnover unit 41 is attached, the computer 770 jumps to Step 160 and returns to the main program after the fixed processing described previously.

In this manner, after carrying out the subroutine of the processing to confirm preparation of copying, the computer 770 returns to the main program and then carries out the next step.

Figure 9:
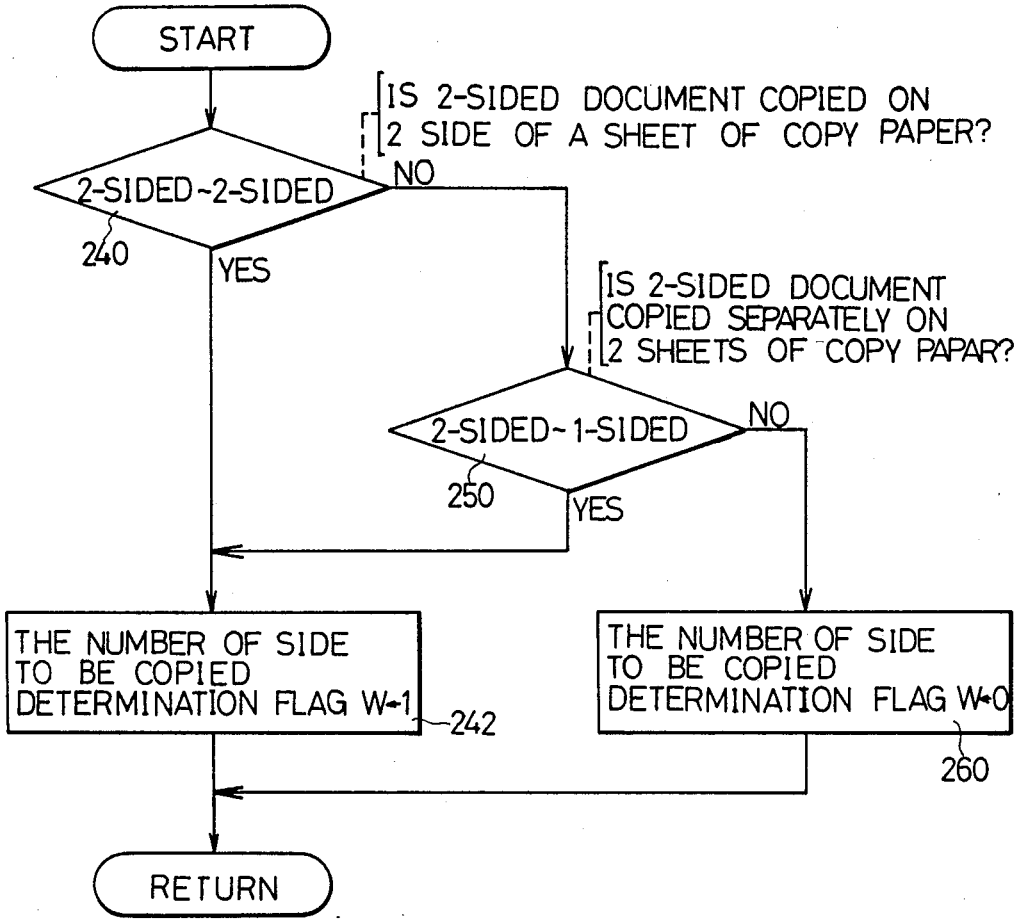

Next, the computer 770 carries out the subroutine for copy preparation of Step 112 or 116 as shown in FIG. 6, FIG. 8 and FIG. 9.

This subroutine starts to carry out Step 200. Step 200 and Step 202 make the same determination as those of Step 140 and Step 141, respectively. When it is determined at Step 202 that the document 90 was placed on the automatic document take-up unit 35, the computer 770 determines at Step 204 if the signal from the copy side designating unit is one-sided copy signal or two-sided copy signal by the value of the copy side determination flag "W". This copy side determination flag "W" is determined by the subroutine shown in FIG. 9. This subroutine is carried out from Step 240. If it is determined at Step 240 that the signal from the copy side designating unit 75 is the signal to indicate both sides of the document 90 is copied on both sides of a sheet of copy paper, the computer 770 proceeds to Step 242. Then, the computer 770 sets the copy side determination flag "W" to 1 and returns to the main program. If the determination at Step 240 is denial, the computer 770 proceeds to Step 250. If it is determined at Step 250 that the signal from the copy side designating unit 75 is the signal which indicates both sides of the document 90 is copied on one side of two sheets of copy paper 90, the computer 770 proceeds to Step 242 and takes the same processing described previously. If it is other than those determinations, the computer 770 proceeds to Step 260 and sets the copy side determination flag "W" to 0, and then returns to the main program.

If it is determined at Step 204 that the signal from the copy side designating unit 75 is not the signal for two-sided document copying, the computer 770 proceeds to Step 206 and produces both control signals to put on the green colored luminous diode 795 indicating the approval of automatic copying and to put off the red colored luminous diode 797 indicating the disapproval of automatic copying, and then the computer 770 proceeds to Step 208.

If it is determined at Step 204 that said signal is the two-sided copy signal, computer 770 jumps to Step 220 and determines according to the signal from the attachment detector 73 if the document turnover unit 41 is attached to the copying machine body. If it is determined that the document turnover unit 41 is attached, the computer 770 jumps to Step 206 and carries out the processing described previously.

If it is determined at Step 200 that various conditions necessary for copying are not completed, or determined at Step 202 that the document 90 is not placed on the automatic document take-up unit 35, or determined at Step 220 that the document turnover unit 41 is not attached to the copying machine body 30, the computer 770 jumps to Step 230. Step 230 is the Step to produce both control signals to put off the green colored luminous diode 795 indicating the approval of automatic copying and to put on the red colored luminous diode 797 indicating the disapproval of automatic copying.

Then after carried out either Step 206 or Step 230, the computer 770 carries out Step 208.

Step 208 is the step to examine whether the automatic copy impossible indicator 793 is on or off. That is, when it is determined that the green colored luminous diode 795 indicating the approval of automatic copying is not on, the computer 770 returns to the main program immediately since the automatic copy instructing unit can not be operated. Otherwise, the computer 770 proceeds to Step 210.

The computer 770 determines at Step 210 if the paper feed roller 353 can handle the document pile 90 one by one and send it forward by the signal from a sensor (not shown) detecting if the fore edge of the document contacts the paper feed roller 353. If computer 770 determines it is not possible to feed, the computer 770 returns to the main program.

If the computer 770 determines it is possible to feed, the computer 770 at Step 212 sets the parameter A which determines to drive the automatic document take-up unit 35 to "A=1" which indicates approval of the driving and then the computer 770 returns to the main program.

According to this embodiment, even if the user operates the A.D.F. start button 791 in order to copy both sides of the document 90 without knowing that the document turnover unit 42 is not attached to the copying machine body 30, the automatic document take-up unit 35 is not operated and an indication will be given, so that the user can avoid unnecessary copying work.

Meanwhile, in the embodiment described previously, there are two start buttons set separately; one is for the copying by the automatic document take-up unit 35, the other is for the copying by manual operation without the automatic document take-up unit 35. Further, only one button can be substituted for the two buttons. In such a case, the function of the A.D.F. start and the normal manual copy start is automatically interchangeable in one switch by judging whether the document is on the receiving tray of the automatic document take up unit or not.

What is claimed as new and desired to be secured by letters patent of the United States is:

1. A copying machine comprising:

a copying machine body having a glass plate on which a document to be copied is placed;

document feeding means for automatically forwarding said document to said glass plate;

document turnover means for turning over from one side to another side a document discharged from said document feeding means and sending said document back to said document feeding means;

copy side designating means selectively designating a two-sided copy mode by which both sides of said document are copied;

an attachment detecting means for detecting whether said document turnover means is attached to said copying machine body in a state ready to be used;

prohibiting means for inhibiting the use of said document feeding means when said two-sided copy mode is designated by said copy side designating means and said document turnover means is detected by said detecting means as not ready to be used.

2. The copying machine as claimed in claim 1, wherein said prohibiting means is a display means.

3. The copying machine as claimed in claim 1, wherein said prohibiting means is means for prohibiting the drive of said document feeding means.

4. A copying machine comprising:

a copying machine body having a glass plate on which a document to be copied is placed;

document feeding means for automatically forwarding said document to said glass plate;

image forming means for forming an image of said document on copy paper provided within said copying machine body;

document turnover means detachably attached to said copying machine body, which turns over from one side to another side said document discharged from said document feeding means and sends said document back to said document feeding means;

copy side designating means selectively designating a two-sided copy mode by which both sides of said document are copied;

an attachment detecting means for detecting whether said document turnover means is attached to said copying machine body;

prohibiting means for inhibiting the use of said document feeding means when said two-sided copy mode is designated by said copy side designating means and said document turnover means is detected by said detecting means as not attached to said copying machine body.

5. The copying machine as claimed in claim 4, wherein said prohibiting means is a display means.

6. The copying machine as claimed in claim 4, wherein said prohibiting means is means for prohibiting the drive of said document feeding means.

* * * * *